US008209888B2

(12) United States Patent
Lanser

(10) Patent No.: US 8,209,888 B2
(45) Date of Patent: Jul. 3, 2012

(54) TRENCHING CHAIN

(76) Inventor: Jerry L. Lanser, Longmont, CO (US)

( * ) Notice: Subject to any disclaimer, the term of this patent is extended or adjusted under 35 U.S.C. 154(b) by 9 days.

(21) Appl. No.: 12/592,079

(22) Filed: Nov. 20, 2009

(65) Prior Publication Data

US 2011/0119965 A1 May 26, 2011

(51) Int. Cl.
*E02F 3/14* (2006.01)
*E02F 9/28* (2006.01)

(52) U.S. Cl. ..... 37/465; 37/462; 37/355; 299/34.01

(58) Field of Classification Search ..... 37/465, 37/462, 464, 352, 355; 299/79.1, 85.1, 80.1, 299/82.1, 84.1, 85.2, 108, 34.01, 34.12
See application file for complete search history.

(56) References Cited

U.S. PATENT DOCUMENTS

| | | | | | |
|---|---|---|---|---|---|
| 1,052,972 | A | * | 2/1913 | Sargent | 198/705 |
| 1,414,586 | A | * | 5/1922 | Russell | 299/45 |
| 1,468,914 | A | * | 9/1923 | Morgan | 299/85.2 |
| 1,481,602 | A | * | 1/1924 | Greimann | 37/352 |
| 1,896,711 | A | * | 2/1933 | Lichtenberg | 37/465 |
| 2,501,083 | A | * | 3/1950 | Owen | 37/300 |
| 2,519,076 | A | | 8/1950 | Schmidt | |
| 2,594,991 | A | | 4/1952 | Protzeller | |
| 2,601,978 | A | * | 7/1952 | Simmons | 299/82.1 |
| 2,636,291 | A | * | 4/1953 | Reagle | 37/352 |
| 2,648,145 | A | * | 8/1953 | Askue | 37/347 |
| 2,749,950 | A | * | 6/1956 | Jamieson et al. | 83/831 |
| 2,753,978 | A | * | 7/1956 | Kerr | 198/704 |
| 2,946,142 | A | | 7/1960 | Swanson | |
| 3,010,334 | A | * | 11/1961 | Bansemer | 198/712 |
| 3,022,588 | A | * | 2/1962 | Brown | 37/465 |
| 3,152,412 | A | * | 10/1964 | Benetti | 37/352 |
| 3,225,468 | A | * | 12/1965 | Benetti | 37/352 |
| 3,319,364 | A | * | 5/1967 | Evans | 37/356 |
| 3,846,922 | A | * | 11/1974 | Horton | 37/353 |
| 4,195,427 | A | * | 4/1980 | Lanham | 37/362 |
| 4,827,636 | A | | 5/1989 | Emming | |
| 4,843,742 | A | * | 7/1989 | Camelleri | 37/360 |
| 4,893,464 | A | * | 1/1990 | Thuerman | 59/78 |
| 5,189,817 | A | | 3/1993 | Schroeder | |
| 5,212,895 | A | * | 5/1993 | Camilleri | 37/364 |
| RE34,620 | E | * | 5/1994 | Camilleri | 37/362 |
| 5,930,923 | A | * | 8/1999 | Nishiguchi | 37/351 |
| 6,014,826 | A | * | 1/2000 | Walgren et al. | 37/456 |
| 6,108,947 | A | * | 8/2000 | Brand et al. | 37/338 |
| 6,154,987 | A | * | 12/2000 | Rumer et al. | 37/352 |
| 6,684,538 | B2 | * | 2/2004 | Rumer et al. | 37/465 |
| 6,854,201 | B1 | | 2/2005 | Hunter et al. | |

* cited by examiner

*Primary Examiner* — Thomas Beach
*Assistant Examiner* — Matthew Buck
(74) *Attorney, Agent, or Firm* — Harold A. Burdick

(57) ABSTRACT

Trenching chains and chain links are disclosed, the trenching chains including a plurality of chain link bodies joined at the ends thereof and a plurality of carriages each having one end pivotably attached at an end of a link body and an opposite end unengaged and freely pivotable. Cutting or trench sweeping implements are maintainable on the carriages. The carriages can thus be configured with lengths greater than the lengths of the link bodies.

14 Claims, 9 Drawing Sheets

TRENCHING CHAIN

FIELD OF THE INVENTION

This invention relates to cutting chains for trenchers and, more particularly, relates to such chains having specially configured trench cutting teeth.

BACKGROUND OF THE INVENTION

Trenchers for cutting trenches to bury electrical lines and conduit, telecommunications installations and plumbing lines are in use which include cutting chains mounted to booms associated with motorized carriers of various size and construction. Edgers for landscape work (fabric installation, for example) have also heretofore been utilized. Chains used with such known trenchers and edgers are variously constructed, having a chain cutting tooth pitch typically between two and six, and use cutting teeth or frost/rock bits (some with carbide insertions or the like) that are bolted or welded in a fixed tooth design to the chain links (see, for example, U.S. Pat. Nos. 2,519,076, 2,594,991, 2,946,142, 3,846,922, 4,893,464, 6,014,826, and 6,854,201).

These fixed tooth designs store energy and amplify chain link stress and strain as the chain is used, such forces being greater as the chain travels around the chain drive sprocket, guide/idler pulleys and/or nose wheel of the trencher. Thus, such implements and can increase link wear thus challenging chain durability (leading to broken and/or stretched chains/links). These forces also require tooth securement techniques that are calculated to resist such extremes, thus limiting the ways in which teeth and bits can be attached to the chain. Since cutting forces are applied one tooth at a time in such fixed tooth designs, significantly larger chains/teeth and more applied power to the chain are required.

Many field applications require only a narrow, shallow trench, for example when burying small conduit or pipe under concrete slabs, when installing landscape sprinkler systems or landscape fabric. These tasks typically underutilized current trencher and trencher chain types which are too large and too unwieldy in such applications. Moreover, heretofore known trenchers can cause undue landscape damage, are messy, and/or leave residue (dislodged particles, called "crumbs") in the trench, making them less than ideal for small trench applications.

Further improvement in trencher chain design could thus be utilized directed to such recognized deficiencies.

SUMMARY OF THE INVENTION

Trenching chains and chain link clips are provided by this invention that are configured to continuously clean/sweep dislodged dirt and particles from the bottom of the trench during use. The chains and link clips of this invention are more durable and store less energy in operation than existing designs, while extending the twisting and cutting forces over two or more links thereby allowing lighter gear, requiring less applied force and distributing the digging forces more evenly along the chain. The structures of this invention include a flat surface portion allowing more versatility for cutting tooth/bit attachment. The trenching chains and link clips herein include clips at least some of which have a cutting implement mounted on a carriage, each clip having one end pivotably attached at a trenching chain link and an opposite end unengaged and freely pivotable. The clips thus can be configured with carriage lengths greater than the lengths of the link bodies.

The trenching chain clip is pivotably attachable to a trenching chain link body, the clip including a carriage configured for mounting of a cutting implement thereat. The carriage has one part adapted for pivotable engagement with the trenching chain link body so that the clip is freely pivotable toward and away from the link body. The trenching chain includes a plurality of joinable links and a plurality of clips each having one end pivotably attached at one of the links, the opposite end remaining unengaged and freely pivotable.

More particularly, trenching chain link bodies are pivotably joinable with adjacent link bodies at first and second ends, a link body length defined between the first and second ends. The carriages each have one end pivotably attached at the first end of one of the link bodies and an opposite end unengaged and freely pivotable, carriage length defined between the one end and the opposite end being greater than link body length. Cutting implements are maintained on the carriages.

It is therefore an object of this invention to provide improved trenching chain and trenching chain clips.

It is another object of this invention to provide trenching chains and chain clips that continuously clean/sweep dislodged dirt and particles from the bottom of the trench during use.

It is still another object of this invention to provide trenching chains and chain clips that are more durable and store less energy in operation.

It is another object of this invention to provide trenching chains and chain clips that accommodate more versatility for cutting tooth/bit attachment.

It is yet another object of this invention to provide trenching chains and chain clips that extend twisting and cutting forces over two or more links thereby allowing lighter gear, requiring less applied force and distributing digging forces more evenly along the chain.

It is another object of this invention to provide a trenching chain clip pivotably attachable to a trenching chain link body, the clip comprising a carriage configured for mounting of a cutting implement thereat, the carriage having one part adapted for pivotable engagement with the trenching chain link body so that the clip is freely pivotable toward and away from the link body.

It is still another object of this invention to provide a trenching chain including a plurality of joinable links and a plurality of clips each having one end pivotably attached at a selected one of the links and an opposite end unengaged and freely pivotable.

It is yet another object of this invention to provide a trenching chain including a plurality of chain link bodies each pivotably joinable with adjacent link bodies at first and second ends thereof, the link bodies each having a length between the first and second ends, a plurality of carriages each having one end pivotably attached at the first end of a selected one of the link bodies and an opposite end unengaged and freely pivotable, the carriages each having a length between the one end and the opposite end thereof, the carriage lengths greater than the link body lengths, and a plurality of cutting implements maintained on the carriages.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
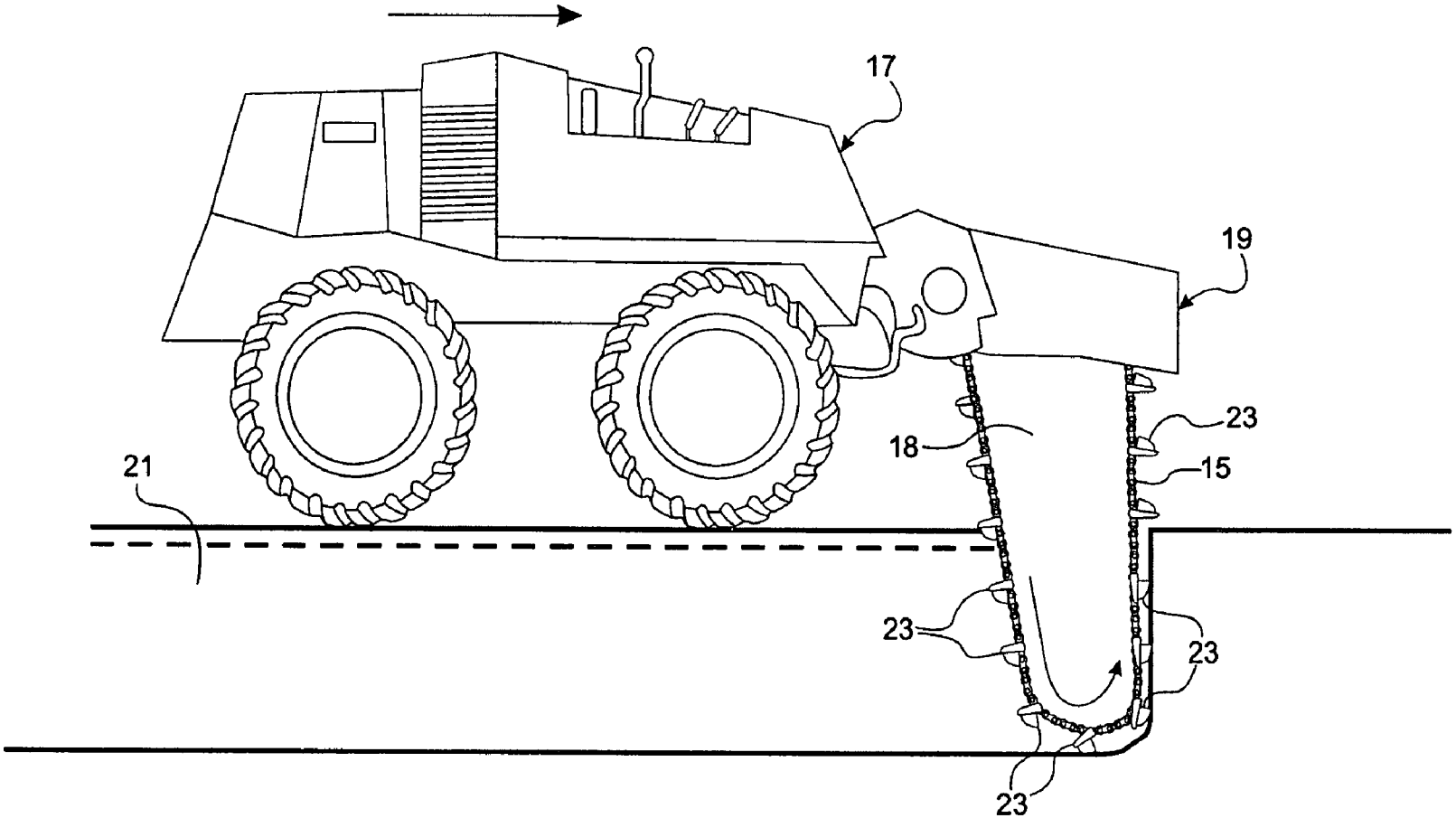
FIG. 1 is a side view which illustrates the trenching chain of this invention in use.
Figure 2:
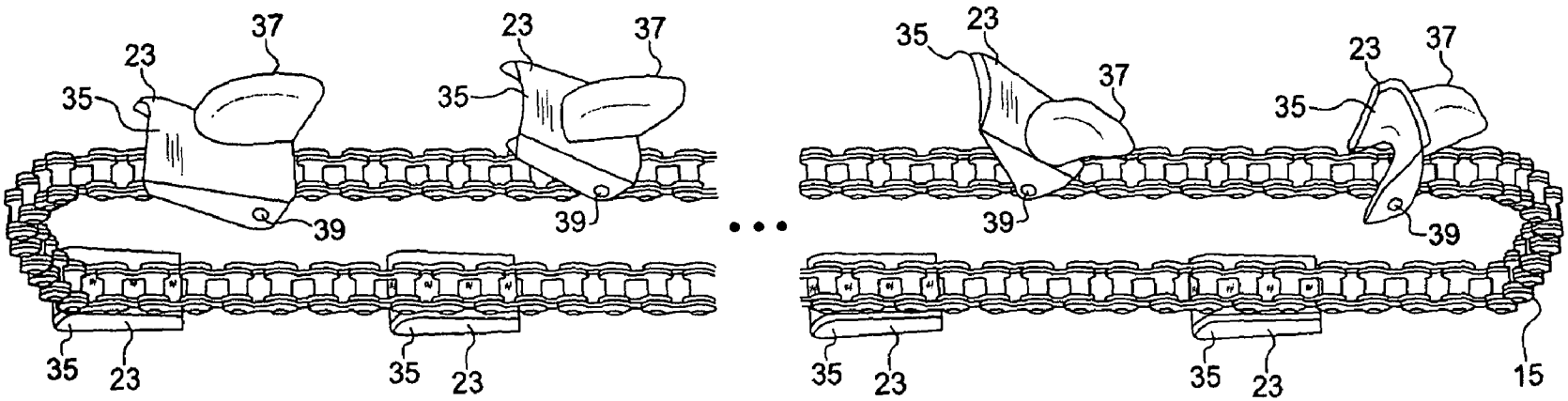
FIG. 2 is perspective view of the trenching chain of this invention.
Figure 3:
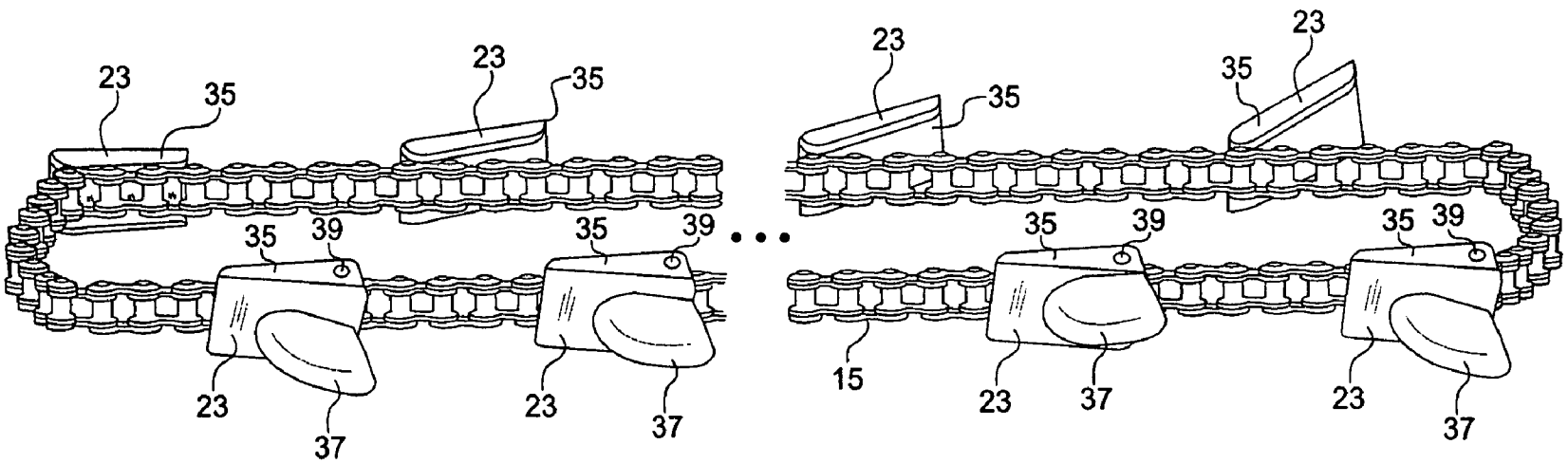
FIG. 3 is another perspective view of the trenching chain shown in FIG. 2.
Figure 4A:
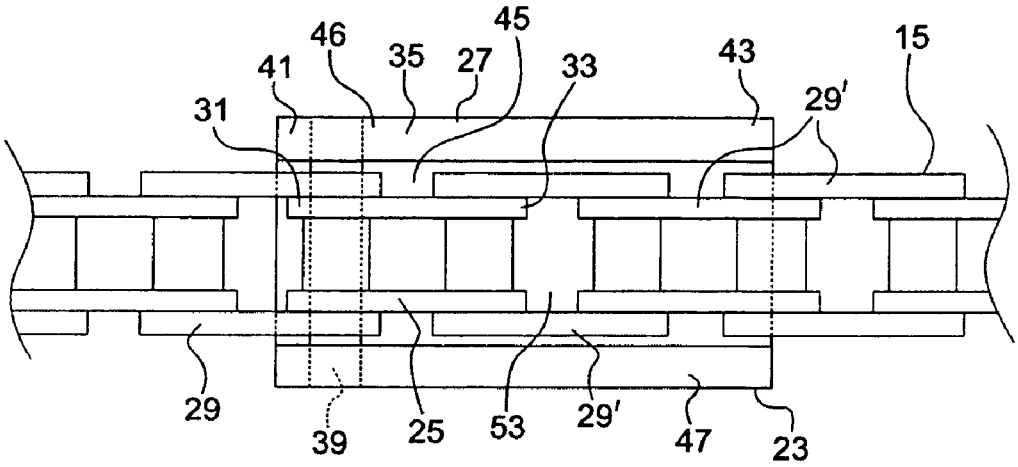
FIG. 4A is a partial bottom view of a portion of the trenching chain shown in FIG. 2.
Figure 4B:
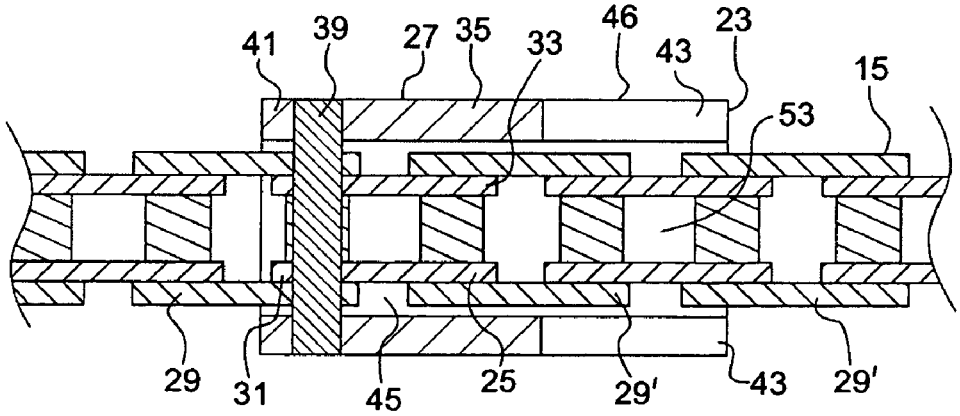
FIG. 4B is a sectional view of the trenching chain as shown in FIG. 4A.
Figure 7:
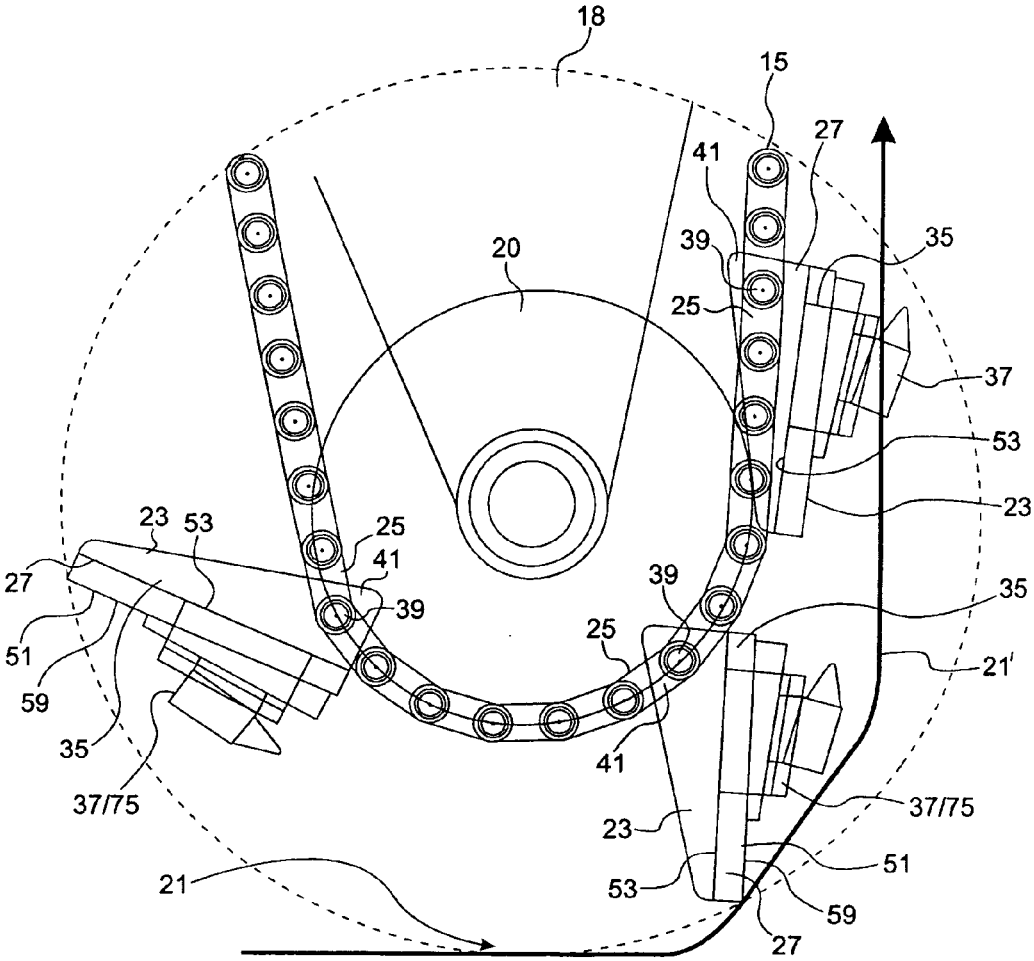
FIG. 7 is an illustration showing functioning of the trenching chain of this invention and also illustrating yet another cutting tooth design associated therewith.

FIG. 1 illustrates trenching chain 15 of this invention in a typical application on a gas powered trencher 17, chain 15 mounted on chain bar 18 of trencher boom 19 (having a chain drive sprocket at one end and a nose wheel 20 (see FIG. 7) at the distal end thereof, for example). While FIG. 1 shows a medium sized trencher type of known design, the chain of this invention could as well be configured and utilized with other trenchers (both larger and, especially, smaller designs). As trencher 17 moves forward astraddle trench 21 being created, trencher chain rotation around the sprocket and nose wheel progressively cuts the trench while continuously cleaning (sweeping) dislodged particles from the trench at cutting link combinations 23 as described hereinafter.

Trenching chain 15 and link combinations 23 are shown in greater detail in FIGS. 2 through 5D. Each of the cutting link combinations 23 includes link body 25 and clip 27. Link body 25 is pivotably joinable with adjacent link bodies 29 and 29' at first and second ends 31 and 33 (see FIGS. 4A and 4B). At least some of clips 27 include carriage 35 and cutting implement 37. Linkage 39 (herein a welded or press fit linking pin, though other known structures could be utilized both separate from and/or integrated with carriage 35 and/or link body 25) pivotably associates carriage 35 with link body 25 as well, in this configuration, as associating link body 25 with adjacent link body 29. Each carriage 35 (and thus clip 27) has end part 41 adapted for pivotable engagement with link body end 31 (using linkage 39, for example, through openings thereat) so that clip 27 is freely pivotable toward and away from link body 25. Opposite end 43 of carriage 35 is unengaged and freely pivotable.

Turning to FIGS. 4A through 5D, carriage 35 includes flat mounting portion 45 between spaced (preferably wedge shaped) sides 46 and 47 each having end part 41 thereat. Cutting implement 37 is secured (welded, bolted or the like, in this embodiment) at top surface 51 of mounting portion 45, link bearing surface 53 provided opposite surface 51. Sides 46 and 47 are spaced sufficiently to enable freely pivoting movement of link body 25 and adjacent link body or bodies 29' into and out of adjacency and/or contact with link bearing surface 53 of mounting portion 45 therebetween during trenching chain use. Carriage 35 length between opposite ends 41 and 43 is preferably greater than link body 25 length between first and second ends 31 and 33 (and preferably at least twice the length of body 25 or longer). As shown herein and addressed specifically with respect to FIGS. 9 and 10, cutting implements 37 of clip 27 may be any of various known or conceivable cutting teeth and/or bit (rock/frost, for example) configurations.

Figure 5A:
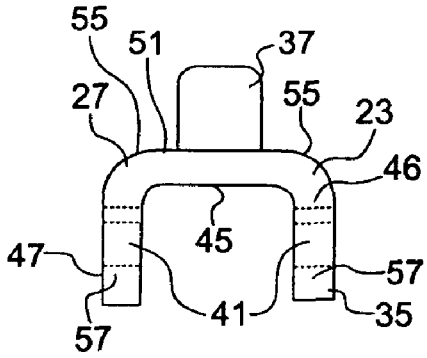
FIGS. 5A through 5D are partial plan views of one carriage/cutting tooth clip combination used with the trenching chain of this invention and illustrating a different cutting tooth design associated therewith.
Figure 5B:
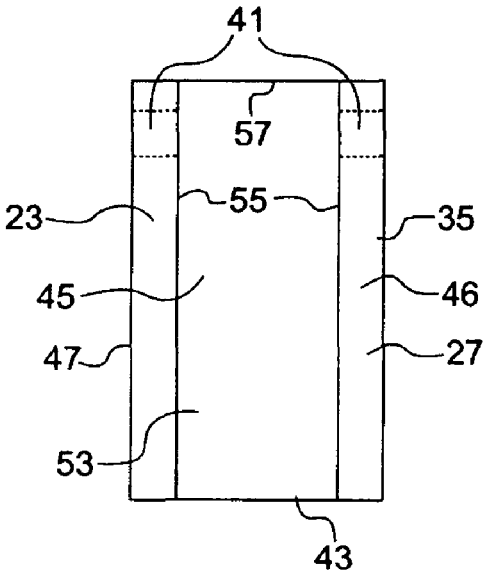
Figure 5C:
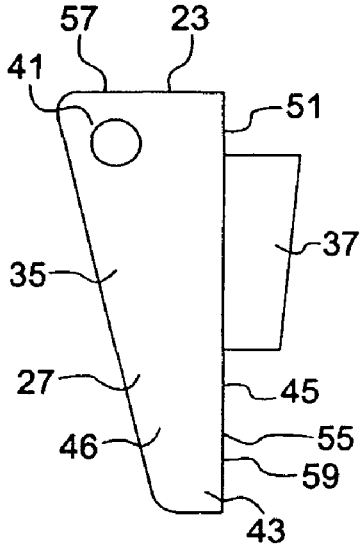
Figure 5D:
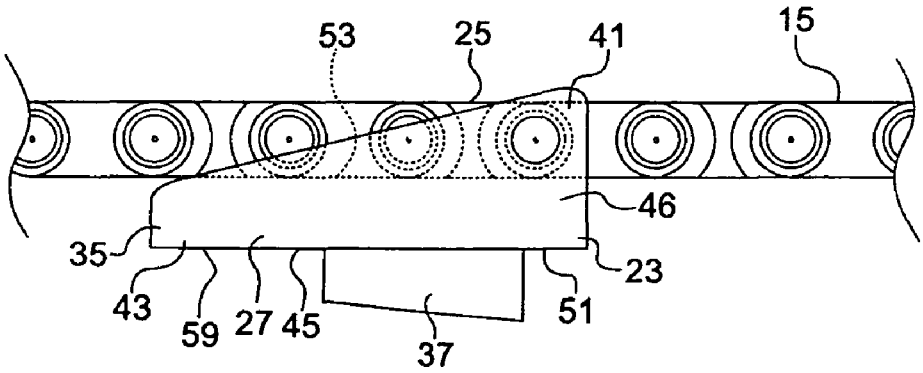
Figure 6A:
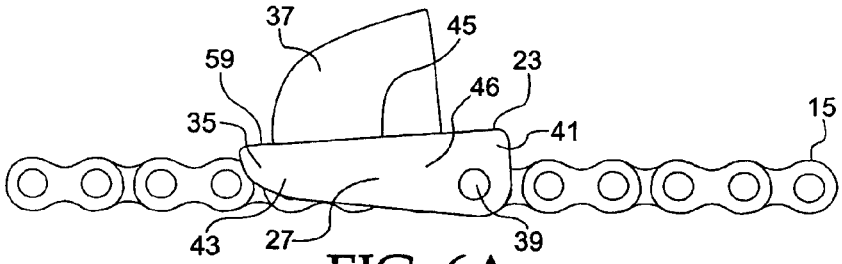
FIGS. 6A through 6D are side view illustrations of operation of the carriage/cutting tooth clip combination of the trenching chain shown in FIG. 2 during use.
Figure 6B:
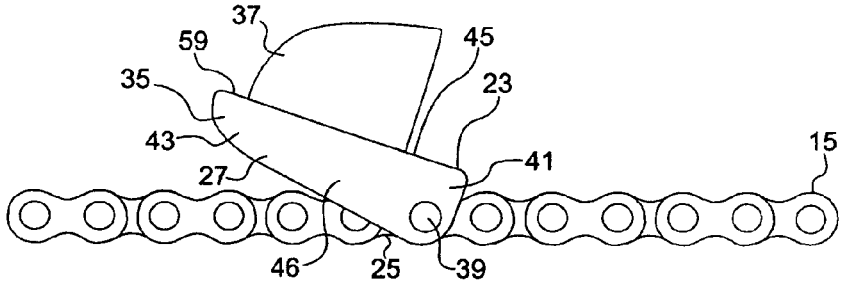
Figure 6C:
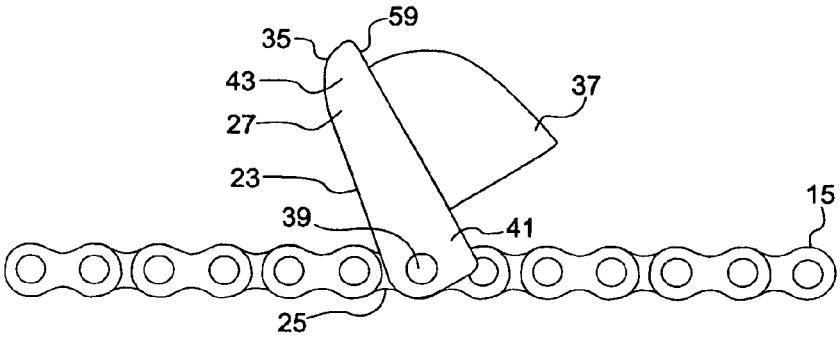
Figure 6D:
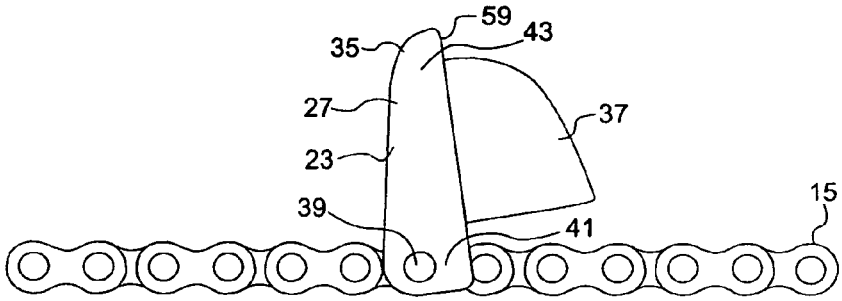

Portion 45 is formed (by forging, milling, welding or bending, for example) between wedge shaped spaced sides 46 and 47 along opposite side edges 55, end part 41 defined adjacent to opposite end edges 57 thereof (see FIGS. 5A through 5C). Clips 27 each have a configuration 59 at opposite end 43 (a broad, flat expanse at the end of top surface 51, for example) adapted for trench sweeping. While cutting implements 37 are shown herein affixed to every carriage 35 of clips 27, some clips may be provided without cutting implements ("sweeper" clips). Moreover, a sweeper chain can be provided utilizing clips without any cutting implements at all. Trenching chain 15 utilizes a plurality of links 25 and 29/29' joined in an endless chain design together with a plurality of clips 27.

As shown in FIGS. 6A through 6D and 7, as chain 15 is rotated about bar 18, cutting implements 37 engage end 21' of trench 21 to move and cut earth thereat. Such engagement causes pivoting of the freely pivotable clips 27 toward chain links 25 and 29/29', the links movable into and out of adjacency and/or contact with carriage bearing surface 53 of mounting portion 45 between sides 46 and 47. As link combinations 23 clear trench 21, clips 27 pivot away from links 25 and 29/29' under force of the rotating chain 15, and are thereby positioned as rotation continues for resilient contact with the bottom of trench 21 to continuously clean/sweep the trench during trenching operations.

Figure 8A:
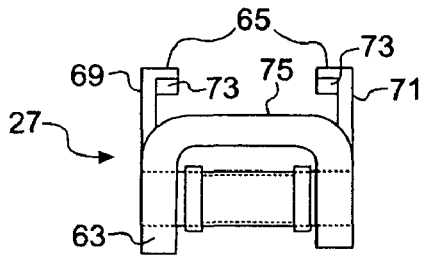
FIGS. 8A and 8B are end views of two different types of tooth mounting usable with the trenching chain and links of this invention.
Figure 8B:
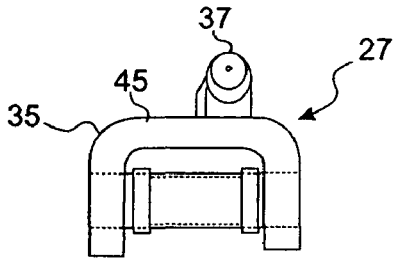

FIGS. 8A and 8B illustrate two different types of carriage 35 and cutting implement 37 engagement utilizable with clips 27. As shown heretofore, FIG. 8B shows direct mounting of implement 37 to mounting portion 45 of carriage 35. FIG. 8A illustrates a clip 27 including a carriage 63 having wedge bracket 65 affixed to the top thereof. Tooth/bit mounting plates 67 (as shown in FIGS. 9A through 100) are wedge mounted between bracket arms 69/71 and between dogs 73 and top mounting surface 75 for ease of tooth/bit replacement or tooth/bit-type change.

Figure 9A:
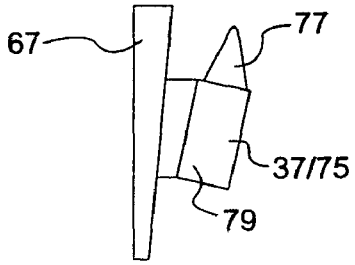
FIGS. 9A through 9C are side view illustrations of various tooth designs utilizable in the trencher chain of this invention.
Figure 9B:
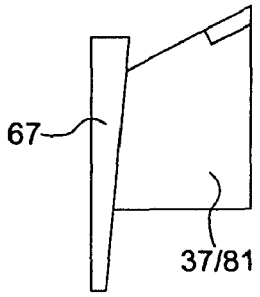
Figure 9C:
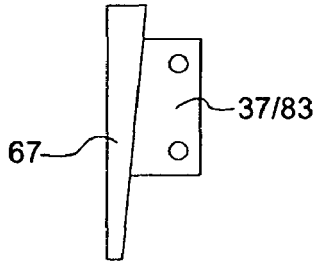
Figure 10A:
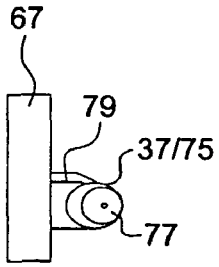
FIGS. 10A through 10C are end view illustrations of the tooth designs shown in FIGS. 9A through 9C, respectively.
Figure 10B:
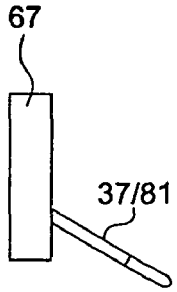
Figure 10C:
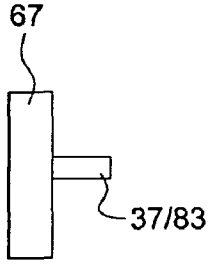

FIGS. 9A through 100 show various tooth, bit and mounting configurations for cutting implements 37 utilizable with this invention (one or more of which may be used per carriage). These are all shown on mounting plates 67 for use as shown in FIG. 8A, though direct mounting as shown in FIG. 8B of these various tooth/bit types can be utilized. Rock/frost bit 75 is shown in FIGS. 9A and 10A having carbide tip 77 mounted at bit mount 79. Offset shark tooth bits 81 are shown in FIGS. 9B and 10B. Center mounted cup teeth 83 are illustrated in FIGS. 9C and 10C. These are not exhaustive of the tooth and bit types or mounting configurations available or conceivable and are included herein for illustrative purposes.

Figure 11A:
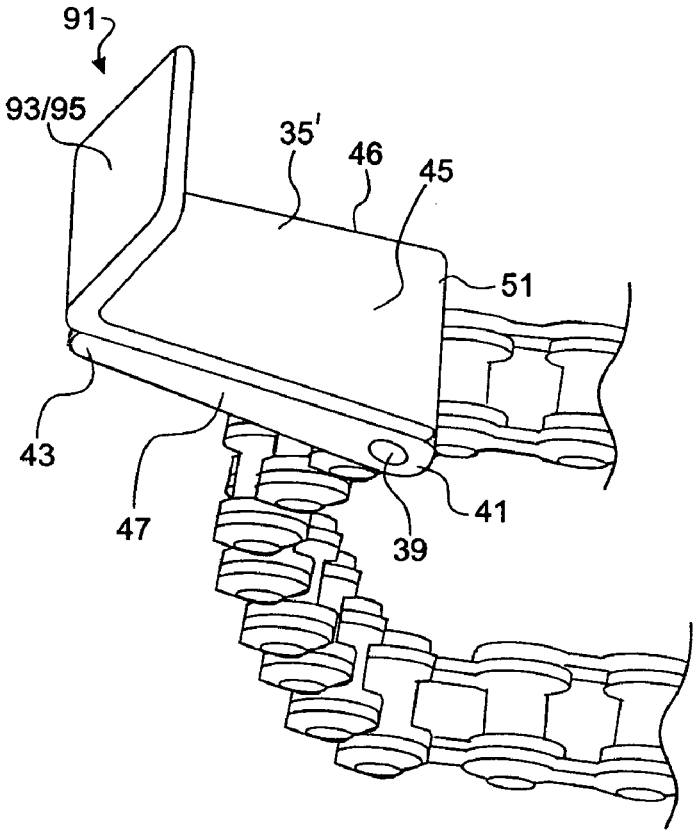
FIGS. 11A and 11B are perspective views of enhanced sweeper clips employable with some trenching chains of this invention for scraping dirt along the trench bottom and/or lifting dirt out of the trench during trenching operations.
Figure 11B:
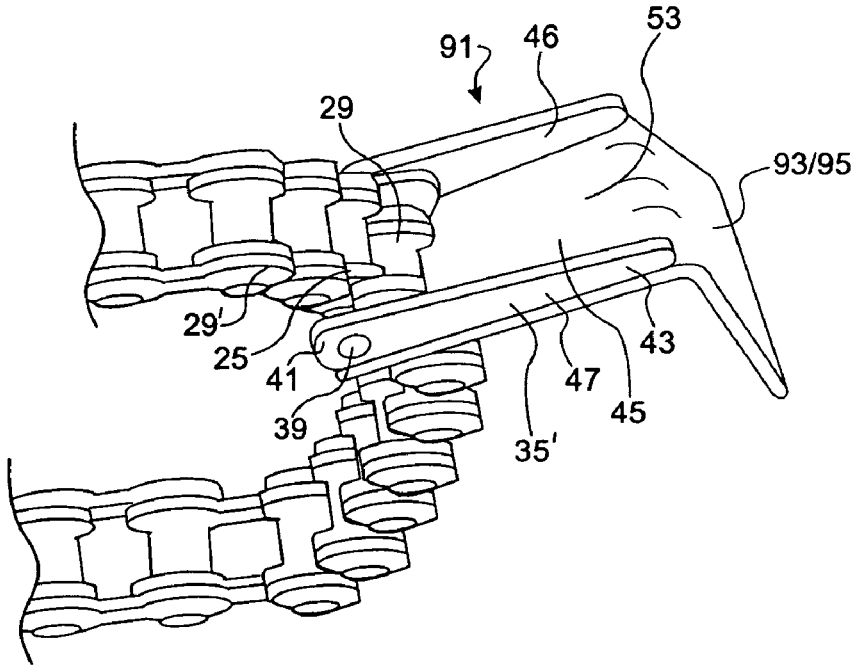

In FIGS. 11A and 11B enhanced sweeper clips 91 are illustrated, such sweeper clips for scraping dirt along the trench bottom and/or lifting dirt out of the trench during trenching operations. Clip 91 can be provided on a dedicated sweeping chain or on a chain including cutting implements 37 (for example, providing one sweeper clip 91 every three to six clips in a trench cutting chain). Clip 91 would be especially useful for larger, slower rotating chains and trenching equipment.

Many of the features of clip 91 are similar to those heretofore described, and where the features are the same the same identifying numerals will be used. Clip 91 is used on chains including link body 25 pivotably joinable with adjacent link bodies 29 and 29'. Adapted carriage 35' is maintained on link body 25 using linkage 39 thereby pivotably associating carriage 35' at end 41 so that opposite end 43 freely pivotable, all as previously described. Carriage 35', like carriage 35, includes flat mounting portion 45 having top mounting surface 51 and link bearing surface 53 between spaced (preferably wedge shaped) sides 46 and 47. Sides 46 and 47 are spaced sufficiently to enable freely pivoting movement of link body 25 and adjacent link body or bodies 29' into and out of adjacency and/or contact with link bearing surface 53 of mounting portion 45 therebetween during trenching chain use.

Carriage 35' has trench scraping and/or dirt lifting implement 93 located at surface 51 of mounting portion 45 adjacent to carriage end 43, implement 93 characterized by angled appendage 95 extending angularly from surface 51 (while a perpendicular extension is shown, a greater or lesser degree of angularity could be utilized). Mounting portion 45 and implement/appendage 93/95 of carriage 35' are preferably unitarily formed, but can be formed utilizing any known processes so long as the carriage is durable (by forging, milling, welding or bending, for example).

The component parts shown herein are preferably made of iron or steel and may be cast or milled or otherwise formed (utilizing sheet or angle/channel material, for example). The cutting teeth/bits may include unitary structures or multi-part structures (including, for example, carbide tips). Linkages may be accomplished using steel linking pins (as shown), or may employ linking structure incorporated into any of the linked parts.

As may be appreciated from the foregoing, improved trenching chains and links are provided by this invention wherein use of a single clip pivot point on cutting tooth carriages allows the trailing end of the clip to continuously clean/sweep dislodged dirt and particles from the bottom of a trench during trench formation. This structure also accommodates considerably less stored energy at the clips than heretofore possible and is thus safer to operate. The particular configurations taught herein extend the twisting and cutting forces over two or more cutting chain links thereby distributing the digging forces more evenly along the chain, are durable and lightweight, and accommodate fast and easy chain change and maintenance.

What is claimed is:

1. A trenching chain clip pivotably attachable to a trenching chain link body at a linkage joining adjacent link bodies, said clip comprising a carriage configured for mounting of a cutting implement thereat, said carriage including spaced sides with a mounting portion therebetween, said mounting portion for implement location at one surface thereof and providing a link bearing surface opposite said one surface, said sides of said carriage each having one part at an end thereof adapted for pivotable engagement with the trenching chain link body at said linkage so that said clip is freely pivotable toward and away from the link body on said linkage, said sides spaced to enable pivoting movement of the link body into and out of contact with said link bearing surface of said mounting portion therebetween during trenching chain use.

2. The trenching chain clip of claim 1 wherein the link body has first and second ends configured to be pivotably engaged, said carriage further including opposite ends, one of said opposite ends at said one part pivotably engageable at the first end of the link body.

3. The trenching chain clip of claim 1 further comprising an implement located at said one surface of said mounting portion, and wherein said implement includes at least one of a cutting tooth, a bit, and a trench scraper.

4. The trenching chain clip of claim 1 further comprising an enhanced sweeping implement including an angled appendage located at said one surface of said mounting portion adjacent to a carriage end opposite said one part.

5. The trenching chain clip of claim 1 wherein the link body has a length between first and second ends thereof and wherein said carriage has a length between opposite ends thereof, said carriage length greater than the link body length.

6. A trenching chain comprising:

a plurality of links joinable using linking pins; and a plurality of clips each having one end pivotably attached at a selected one of said linking pins and an opposite end unengaged and freely pivotable toward and away from an adjacent one of said links, each of said clips including wedge shaped spaced sides with a flat surface portion therebetween along first opposite edges of said wedge shaped spaced sides, said wedge shaped spaced sides defining said one end adjacent to second opposite edges thereof, said spaced sides of said clips sufficiently spaced to enable pivoting movement of said links into and out of contact with said flat surface portion during trenching chain use.

7. The trenching chain of claim 6 wherein said clips each have a configuration at said opposite end adapted for trench sweeping.

8. The trenching chain of claim 6 wherein at least some of said clips have a cutting implement maintained at said flat surface portion thereof.

9. A trenching chain utilized on a trencher for trench digging comprising:

a plurality of chain link bodies each pivotably joinable with adjacent said link bodies at first and second ends thereof, said link bodies each having a length between said first and second ends;

linkages for joining said link bodies;

a plurality of carriages each having one end pivotably attached at said first end of a selected one of said link bodies using said linkage thereat and an opposite end unengaged and freely pivotable toward and away from adjacent ones of said link bodies, said carriages each having a length between said one end and said opposite end thereof, said carriage lengths greater than said link body lengths; and a plurality of cutting implements maintained on said carriages.

10. The trenching chain of claim 9 wherein said carriage lengths are equal to or greater than twice said link body lengths.

11. The trenching chain of claim 9 wherein each of said carriages includes a surface portion extending between said one end and said opposite end, at least one of said cutting implements mountable on said surface portion, and said surface portion at said opposite end being configured for sweeping the trench during use of said trenching chain.

12. The trenching chain of claim 11 wherein said cutting implements are directly mounted to said surface portions.

13. The trenching chain of claim 11 wherein at least some of said carriages include a wedge brackets attached to said surface portions, and wherein said cutting implements are mountable at said wedge brackets.

14. The trenching chain of claim 9 wherein said cutting implements include at least one of cutting teeth and rock/frost bits.

* * * * *